US010236150B2

(12) United States Patent
Oh

(10) Patent No.: US 10,236,150 B2
(45) Date of Patent: Mar. 19, 2019

(54) MOLDED-CASE CIRCUIT BREAKER FOR DC

(71) Applicant: LSIS CO., LTD., Anyang-si, Gyeonggi-do (KR)

(72) Inventor: Kyunghwan Oh, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/841,682

(22) Filed: Dec. 14, 2017

(65) Prior Publication Data

US 2018/0233314 A1 Aug. 16, 2018

(30) Foreign Application Priority Data

Feb. 15, 2017 (KR) ..... 10-2017-0020685

(51) Int. Cl.
*H01H 9/32* (2006.01)
*H01H 9/40* (2006.01)
(Continued)

(52) U.S. Cl.
CPC ..... *H01H 71/0207* (2013.01); *H01H 9/32* (2013.01); *H01H 9/40* (2013.01);
(Continued)

(58) Field of Classification Search
CPC ..... H01H 71/0207; H01H 71/08; H01H 71/2427; H01H 83/02
(Continued)

(56) References Cited

U.S. PATENT DOCUMENTS 6,172,586 B1 * 1/2001 Ferree ..... H01H 71/08 335/202
6,361,848 B1 * 3/2002 Katsube ..... H01H 9/00 428/70
(Continued)

FOREIGN PATENT DOCUMENTS

CN 101211719 A 7/2008
CN 201910333 U 7/2011
(Continued)

OTHER PUBLICATIONS

Translation CN202268314 (Original Doc. published Jun. 6, 2012).*
(Continued)

*Primary Examiner* — Edwin A. Leon
*Assistant Examiner* — William A Bolton
(74) *Attorney, Agent, or Firm* — K&L Gates LLP

(57) ABSTRACT

The present invention relates to a molded-case circuit breaker for direct current (DC), and more particularly, to a molded-case circuit breaker for DC in which a connecting conductor for connecting terminals in the DC circuit breaker is configured as an assembly unit and contained in a terminal receiving portion to improve insulation performance and assemblability and reduce occupied space. There is provided a molded-case circuit breaker for DC that contains a plurality of interruption units, the DC circuit breaker including a terminal connecting unit that connects terminals of adjacent interruption units, the terminal connecting unit being placed within a terminal receiving portion on the front or rear of an outer casing of the circuit breaker.

10 Claims, 14 Drawing Sheets

(51) Int. Cl.

| | |
|---|---|
| ***H01H 9/00*** | (2006.01) |
| ***H01H 33/59*** | (2006.01) |
| ***H01H 71/08*** | (2006.01) |
| ***H01H 71/10*** | (2006.01) |
| ***H01H 71/40*** | (2006.01) |
| ***H01H 71/02*** | (2006.01) |
| ***H01H 73/48*** | (2006.01) |
| ***H01R 4/30*** | (2006.01) |
| ***H01R 4/70*** | (2006.01) |
| ***H01R 11/09*** | (2006.01) |

(52) U.S. Cl.
CPC ..... *H01H 33/596* (2013.01); *H01H 71/08* (2013.01); *H01H 71/082* (2013.01); *H01H 71/1045* (2013.01); *H01H 9/0072* (2013.01); *H01H 71/40* (2013.01); *H01H 73/48* (2013.01); *H01H 2071/1036* (2013.01); *H01R 4/30* (2013.01); *H01R 4/70* (2013.01); *H01R 11/09* (2013.01)

(58) Field of Classification Search
USPC ..... 218/147; 335/6, 202
See application file for complete search history.

(56) References Cited

U.S. PATENT DOCUMENTS

| | | | | |
|---|---|---|---|---|
| 7,358,837 | B2 * | 4/2008 | Puskar | H01H 71/0257 335/6 |
| 7,495,534 | B2 * | 2/2009 | Oh | H01H 71/08 335/6 |
| 7,786,831 | B2 * | 8/2010 | Oh | H01H 71/08 200/293 |
| 8,093,965 | B2 * | 1/2012 | Mittelstadt | H01H 11/0006 335/8 |
| 8,757,697 | B2 | 6/2014 | Held | |
| 8,830,025 | B2 | 9/2014 | Nakano et al. | |
| 2008/0157906 | A1 | 7/2008 | Oh | |
| 2012/0138442 | A1 | 6/2012 | Beatty, Jr. et al. | |
| 2016/0079024 | A1 | 3/2016 | Nereau | |

FOREIGN PATENT DOCUMENTS

| | | | |
|---|---|---|---|
| CN | 202268314 | U | 6/2012 |
| CN | 103198983 | A | 7/2013 |
| CN | 104332362 | A | 2/2015 |
| CN | 204155890 | U | 2/2015 |
| CN | 205789789 | U | 12/2016 |
| EP | 1260999 | B1 | 7/2008 |
| JP | H01-122247 | U | 8/1989 |
| JP | 2008166247 | A | 7/2008 |
| JP | 5276534 | B2 | 8/2013 |
| JP | 2014056732 | A | 3/2014 |
| JP | 2015220769 | A | 12/2015 |
| JP | 2017010706 | A | 1/2017 |
| KR | 20080090008 | A | 10/2008 |
| KR | 101076292 | B1 | 10/2011 |
| KR | 2020160002213 | | 6/2016 |

OTHER PUBLICATIONS

European Search Report for related European Application No. 17191843.6; action dated Apr. 18, 2018; (8 pages).
Korean Office Action for related Korean Application No. 10-2017-0020685; action dated Feb. 27, 2018; (5 pages).
Japanese Office Action for related Japanese Application No. 2018-001694; action dated Aug. 14, 2018; (2 pages).
Chinese Office Action for related Chinese Application No. 201711421717.3; action dated Jan. 21, 2019; (10 pages).

* cited by examiner

MOLDED-CASE CIRCUIT BREAKER FOR DC

CROSS-REFERENCE TO RELATED APPLICATION

Pursuant to 35 U.S.C. § 119(a), this application claims the benefit of earlier filing date and right of priority to Korean Application No. 10-2017-0020685, filed on Feb. 15, 2017, the contents of which are incorporated by reference herein in its entirety.

BACKGROUND OF THE INVENTION

1. Field of the Invention

The present invention relates to a molded-case circuit breaker for direct current (DC), and more particularly, to a molded-case circuit breaker for DC in which a connecting conductor for connecting terminals in the DC circuit breaker is configured as an assembly unit and contained in a terminal receiving portion to improve insulation performance and assemblability and reduce occupied space.

2. Description of the Conventional Art

In general, a molded-case circuit breaker (MCCB) is an electrical device that protects a circuit and a load by automatically interrupting the circuit when there is an electrical overload or short circuit. The circuit breaker typically includes a terminal portion provided on the front and rear and forming a circuit connection, a mechanism divided into a fixed contact and a movable contact and mechanically opening and closing a circuit, a trip portion detecting an over-current or short-circuit current in the circuit and causing the mechanism to trip, and an extinguisher for extinguishing an arc produced when interrupting a fault current.

Such a circuit breaker is generally used for alternating current and may be converted for use in DC applications. In order to convert a circuit breaker for AC to one for DC, in the conventional art, connecting conductors (externally connected conductors) may be added to front and rear terminal portions (or a power side terminal portion and a load side terminal portion) of the existing circuit breaker to configure and use circuits in series.

FIG. 1 depicts a perspective view of a four-pole molded-case circuit breaker for AC according to the conventional art. FIG. 2 depicts a perspective view of a four-pole molded-case circuit breaker for DC according to the conventional art. FIG. 3 is an internal perspective view of the circuit breaker of FIG. 2, from which the cover is partially cut away and the externally connected conductors are separated. FIG. 4 is a perspective view of a trip portion shown in FIG. 3. FIG. 5 is an exploded perspective view of tripping mechanisms, terminals, and an externally connected conductor shown in FIG. 4. FIG. 6 depicts a wiring diagram of the four-pole molded-case circuit breaker for DC according to the conventional art.

As is generally known, a molded-case circuit breaker for AC according to the conventional art includes a switch mechanism 3, a contact portion 7, a trip portion 5, and a terminal portion 2*a*, 2*b*, 2*c*, 2*d*, 2*e*, 2*f*, 2*g*, and 2*h* which is placed within an outer casing consisting of a case 1*a* and a cover 1*b*. Other internal components than the switch mechanism 3 are provided for each phase. That is, in the four-pole circuit breaker, these components are provided for each of four phases: R phase, S phase, T phase, and N phase. The terminal portion 2*a*, 2*b*, 2*c*, 2*d*, 2*e*, 2*f*, 2*g*, and 2*h* includes a front terminal portion 2*a*, 2*b*, 2*c*, and 2*d* on the front of the circuit breaker and a rear terminal portion 2*e*, 2*f*, 2*g*, and 2*h* on the rear of the circuit breaker.

In order to use the circuit breaker for DC applications, externally connected conductors 4*a* and 4*b* are attached to the rear terminal portion 2*e*, 2*f*, 2*g*, and 2*h* and the front terminal portion 2*a*, 2*b*, 2*c*, and 2*d*. FIGS. 2 and 3 show an example of a molded-case circuit breaker for DC to which the externally connected conductors are connected The front terminal portion 2*a*, 2*b*, 2*c*, and 2*d* has a plurality of U-shaped externally connected conductors that connect two adjacent terminals. In this example, an N phase front terminal 2*a* and an R phase front terminal 2*b* are connected by a U-shaped externally connected conductor 4*a*, and an S phase front terminal 2*c* and a T phase front terminal 2*d* are connected by a U-shaped externally connected conductor 4*b*. In the rear terminal portion 2*e*, 2*f*, 2*g*, and 2*h*, an I-shaped externally connected conductor 4*b* may be connected to each phase. In the rear terminal portion 2*e*, 2*f*, 2*g*, and 2*h* and the front terminal portion 2*a*, 2*b*, 2*c*, and 2*d*, an insulation barrier 6 may be mounted between each of the externally connected conductors 4*a* and 4*b* in order to ensure insulation.

Referring mainly to FIGS. 3 to 5, the trip portion 5 includes a crossbar 5*b* mounted across a trip portion case 5*a*, a heater 5*d* connected to a fixed contact (not shown) of the contact portion 7, bimetal 5*c* that is bent by heat generated from the heater 5*d* in case of an over-current in a circuit and that presses a contact region 5*b*1 of the crossbar 5*b* to rotate the crossbar 5*b*, a magnet 5*e* that has a magnetic force, an armateur 5*f* that is magnetized in case of a sudden over-current ad rotates in the direction of the magnet 5*e*, and a trip spring 5*g*. A tripping mechanism including the heater 5*d*, bimetal 5*c*, magnet 5*e*, amarteur 5*f*, and trip spring 5*g* is provided for each phase. Each terminal of the front terminal portion 2*a*, 2*b*, 2*c*, and 2*d* may be connected to the heater 5*d*.

FIG. 5 depicts a pair of tripping mechanisms, a pair of terminals, and a U-shaped externally connected conductor 4*a* connecting the pair of terminals. The U-shaped externally connected conductor 4*a* serves to connect two adjacent terminals.

FIG. 6 shows a wiring diagram of the molded-case circuit breaker for DC according to the conventional art. The U-shaped externally connected conductor 4*a* is attached to the front terminal portion 2*a*, 2*b*, 2*c*, and 2*d* in such a manner that a pair of adjacent terminals are connected. A load 8 and a power source 9*a* and 9*b* are connected to the rear terminal portion 2*e*, 2*f*, 2*g*, and 2*h*.

In the DC circuit breaker according to the conventional art, a U-shaped externally connected conductor 4*a* connecting adjacent terminals is required in order to convert a circuit breaker for AC to one for DC applications. Thus, additional operation is needed, and the externally connected conductor is exposed out of the outer casing of the circuit breaker, thus causing a degradation in insulation performance. Moreover, the presence of the externally connected conductor outside the outer casing of the circuit breaker increases occupied space.

SUMMARY OF THE INVENTION

The present invention has been made in an effort to solve the above-described problems, and an aspect of the present invention is to provide a molded-case circuit breaker for DC in which a connecting conductor is configured as an assembly unit and contained in a terminal receiving portion to improve insulation performance and assemblability and reduce occupied space.

An exemplary embodiment of the present invention provides a molded-case circuit breaker for DC that contains a plurality of interruption units, the DC circuit breaker including a terminal connecting unit that connects terminals of adjacent interruption units, the terminal connecting unit being placed within a terminal receiving portion on the front or rear of an outer casing of the circuit breaker.

A mounting portion is provided in the terminal receiving portion and consists of a pair of guide bars that adjoin the bottom of a partition or sidewall.

An insertion slot for inserting the terminal connecting unit is formed by partially cutting away the partition.

The insertion slot is formed at the top of the mounting portion.

The terminal connecting unit comprises: a two-terminal connecting conductor formed from a flat plate; and a mount that is fitted to the mounting portion, with the two-terminal connecting conductor mounted on the top.

The two-terminal connecting conductor has a pair of coupling holes corresponding in position to terminal assembly holes of the terminals.

A recess portion is formed in the middle on one side of the two-terminal connecting conductor, and cutaway portions are formed on both ends thereof.

The mount comprises: a bottom plate, an intermediate plate, and a top plate that are placed at a certain distance apart from each other; supporting posts connecting the bottom plate and the intermediate plate; and a back plate connecting the back sides of the intermediate plate and top plate.

The bottom plate and the intermediate plate each come as a pair to be inserted into the terminal receiving portions of two adjacent interruption units.

Through holes are made through the intermediate plate, supporting posts, and bottom plate and connected to the coupling holes.

The top plate is placed between a pair of intermediate plates.

The two-terminal connecting conductor and the top plate are inserted into the insertion slot, and the mounting portion is fitted between the intermediate plate and the bottom plate.

A pair of partition supports protrude from two top sides of the top plate.

Wall supports protrude from both ends of the intermediate plate and back plate.

The two-terminal connecting conductor is inserted between the top plate and the intermediate plate.

According to a molded-case circuit breaker for DC according to an embodiment of the present invention, a two-terminal connecting conductor is provided to connect two adjacent terminals and therefore no externally connected conductors are required. Accordingly, the user does not need to add more connecting conductors, and the assemblability of the power source and load is improved.

Moreover, since the two-terminal connecting conductor is configured as an assembly unit (terminal connecting unit) to be fitted to a mount, it can be easily assembled to a mounting portion on the case by fitting, which results in higher assemblability.

In addition, since a connecting conductor is configured within the outer casing, external insulation breakdown is prevented and occupied space is reduced.

Further, the number of tripping mechanism components can be reduced, thus leading to a reduction in parts and production cost.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENTS

While the invention has been shown and described with respect to the preferred embodiments, it will be understood by those skilled in the art that various changes and modifications may be made without departing from the spirit and scope of the invention as defined in the following claims.

A molded-case circuit breaker for DC according to embodiments of the present invention will be described in detail with reference to the drawings.

A molded-case circuit breaker for DC with a plurality of interruption units according to an embodiment of the present invention includes a terminal connecting unit 20 that connects two adjacent terminals, the terminal connecting unit 20 being fitted to a terminal receiving portion 12 or 13 placed on the front or rear of an outer casing of the circuit breaker.

Figure 1:
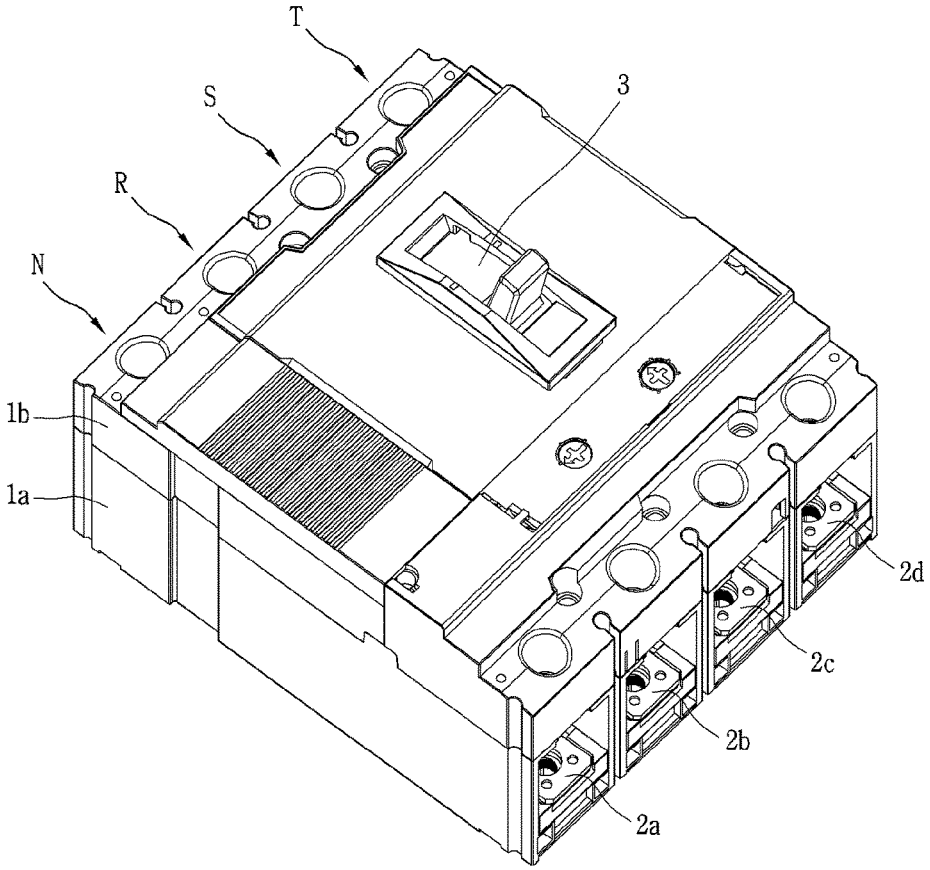
FIG. 1 PRIOR ART
FIG. 1 is a perspective view of a four-pole molded-case circuit breaker for AC according to the conventional art.
Figure 2:
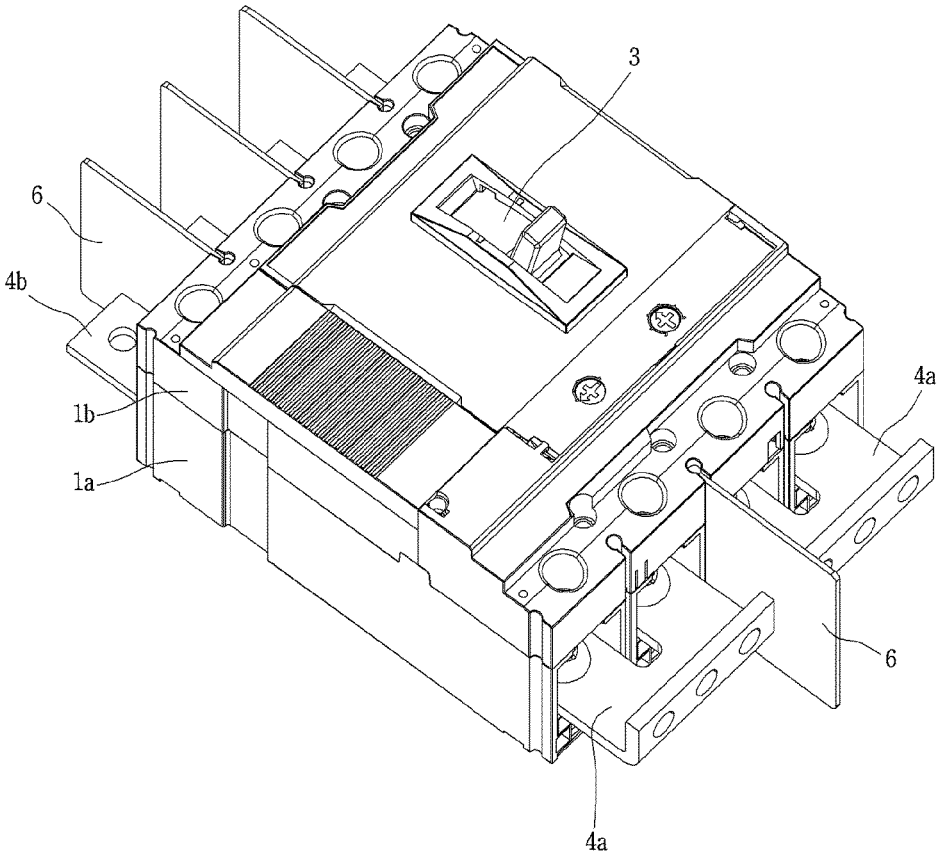
FIG. 2 PRIOR ART
FIG. 2 is a perspective view of a four-pole molded-case circuit breaker for DC according to the conventional art.
Figure 3:
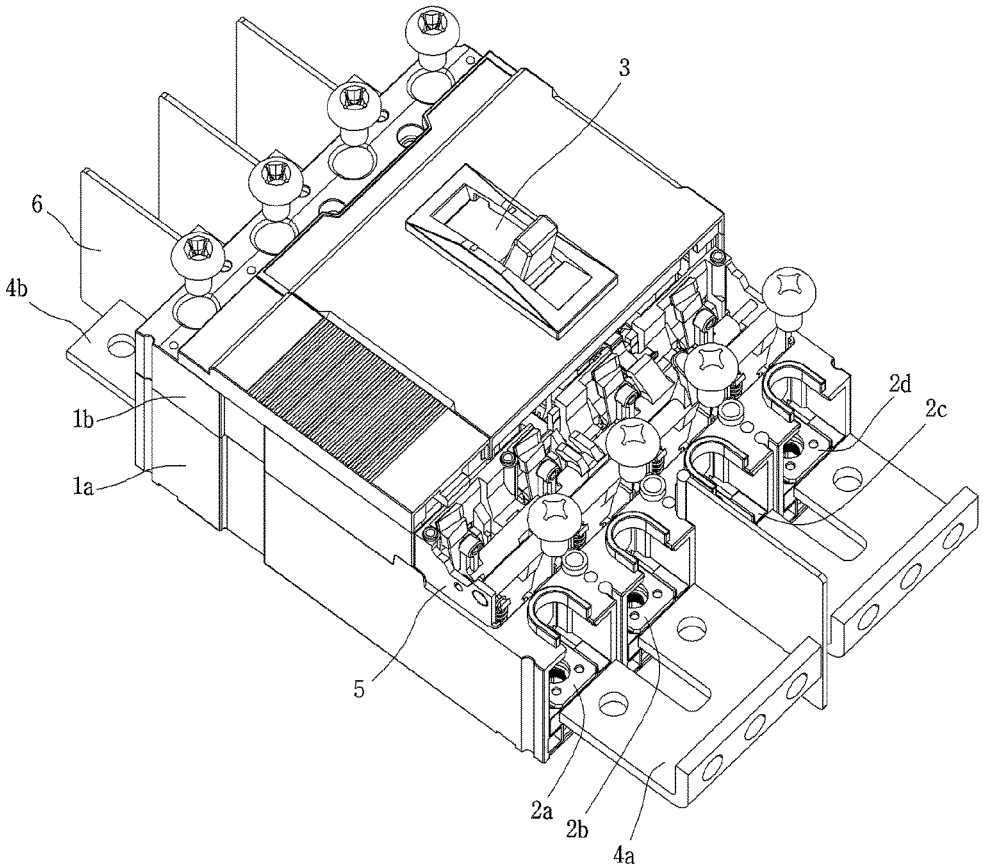
FIG. 3 PRIOR ART
FIG. 3 is an internal perspective view of the circuit breaker of FIG. 2, from which the cover is partially cut away and the externally connected conductors are separated.
Figure 4:
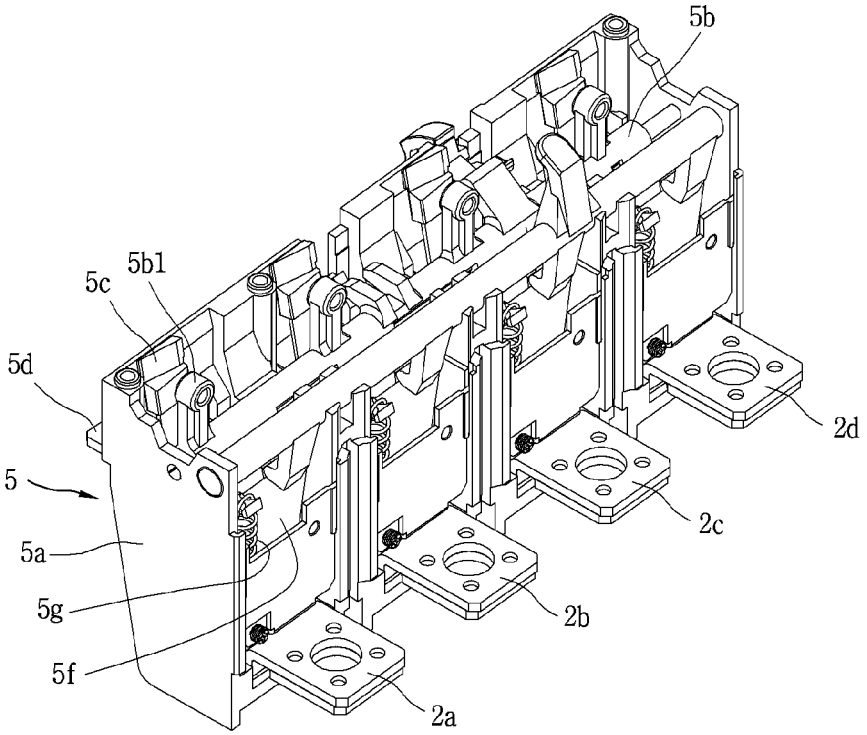
FIG. 4 PRIOR ART
FIG. 4 is a perspective view of a trip portion shown in FIG. 3.
Figure 5:
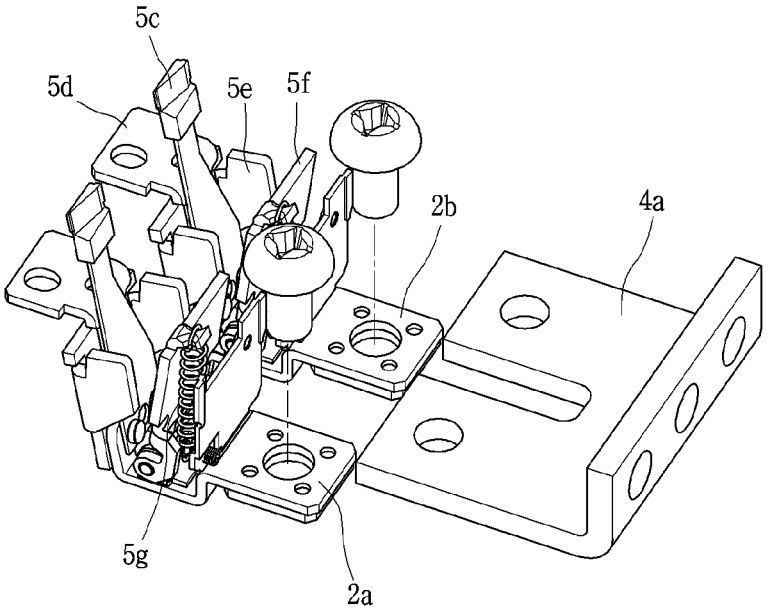
FIG. 5 PRIOR ART
FIG. 5 is an exploded perspective view of tripping mechanisms, terminals, and an externally connected conductor shown in FIG. 4.
Figure 6:
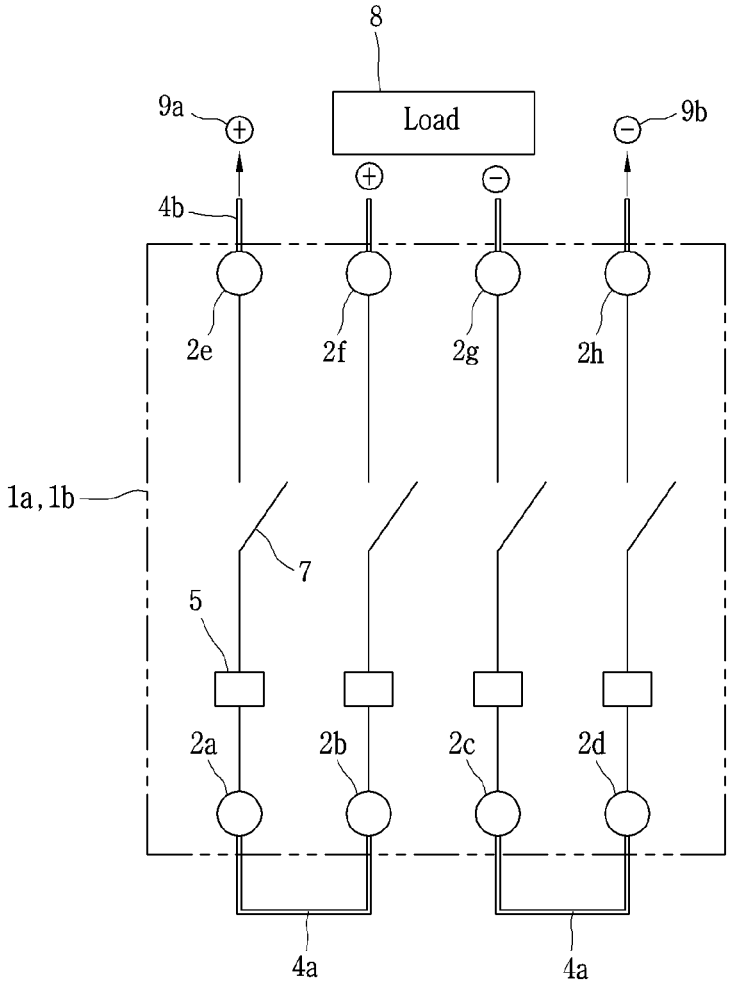
FIG. 6 PRIOR ART
FIG. 6 is a wiring diagram of the four-pole molded-case circuit breaker for DC according to the conventional art.
Figure 7:
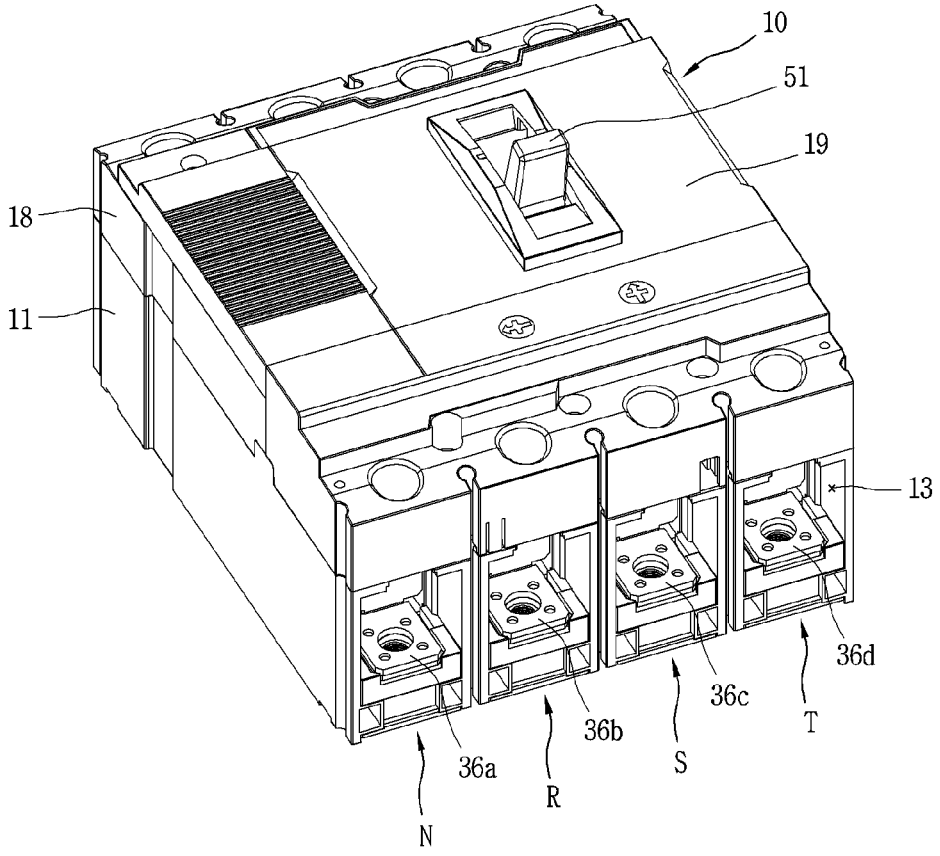
FIGS. 7 and 8 are front and rear perspective views of a molded-case circuit breaker for DC according to an embodiment of the present invention.
Figure 8:
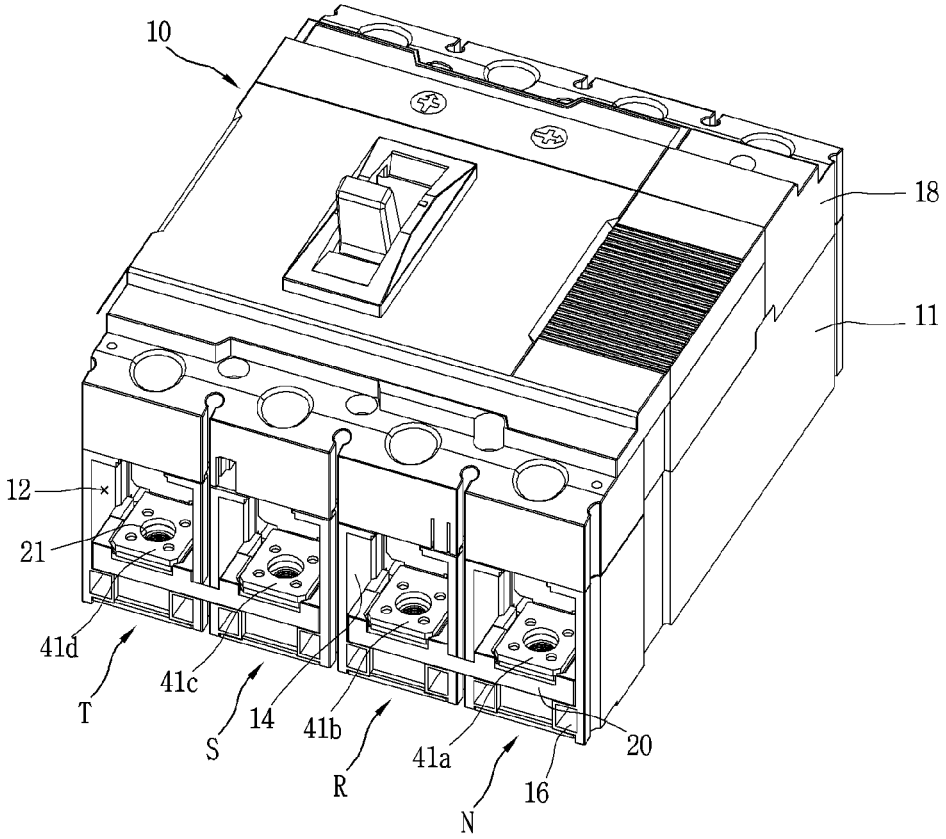
Figure 9:
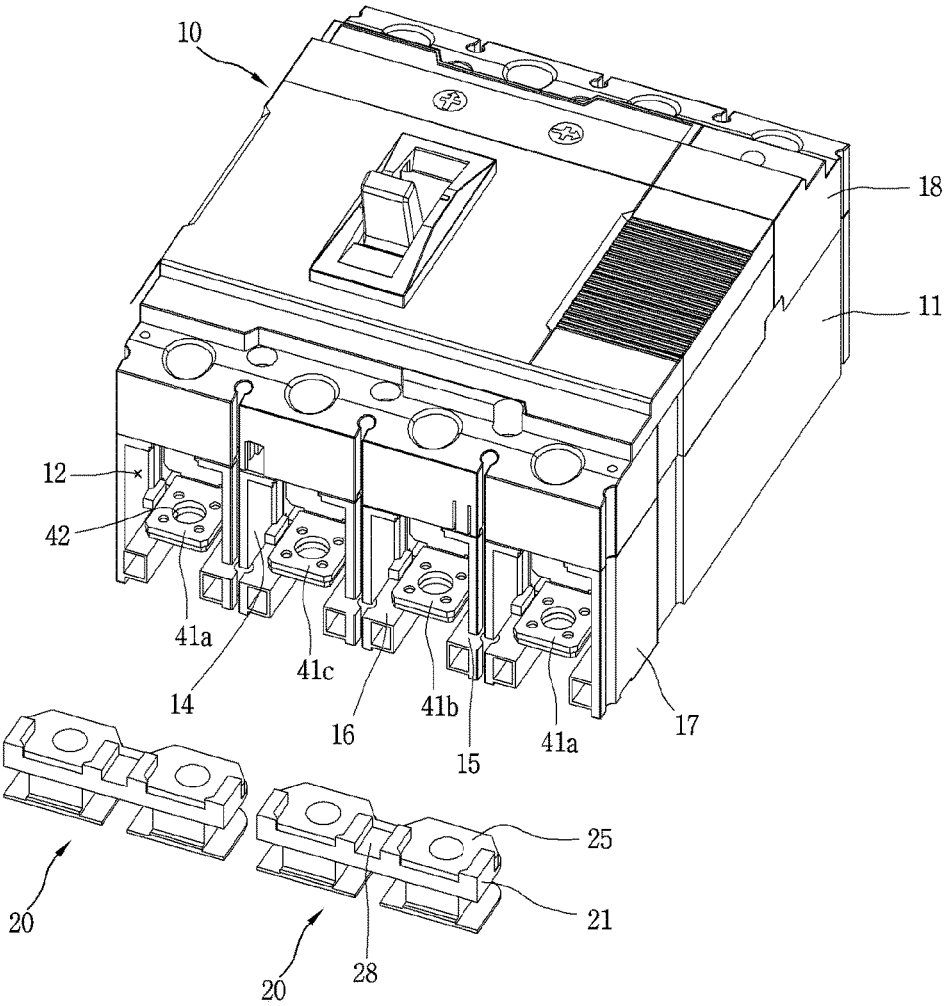
FIG. 9 is a perspective view of the circuit breaker of FIG. 8, from which the terminal connecting units are removed.
Figure 10:
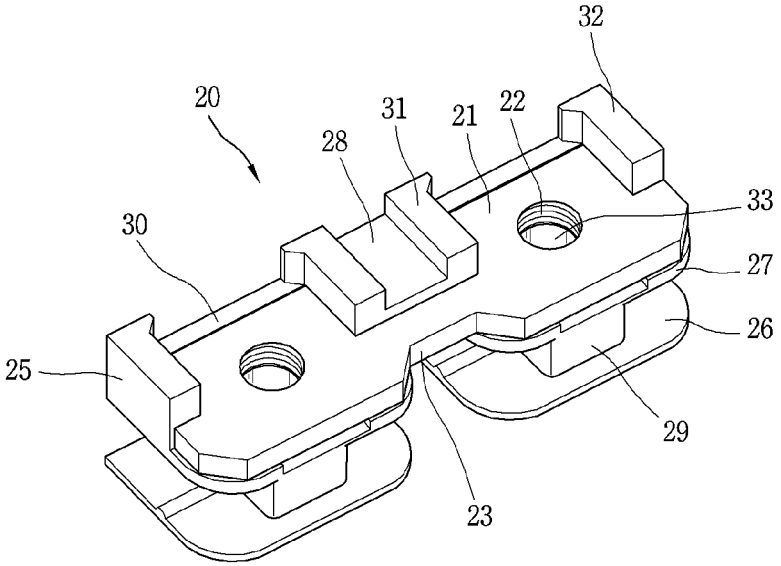
FIG. 10 is a perspective view of a terminal connecting unit applied to a molded-case circuit breaker for DC according to an embodiment of the present invention.
Figure 11:
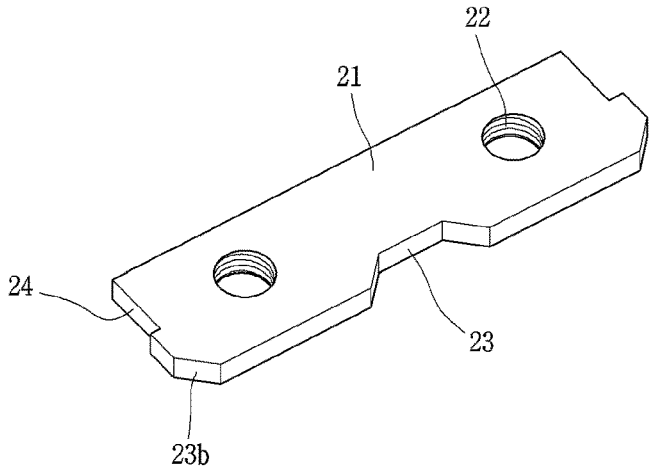
FIGS. 11 and 12 are perspective views of a terminal connecting conductor and a mount that constitute the terminal connecting unit of FIG. 10.
Figure 12:
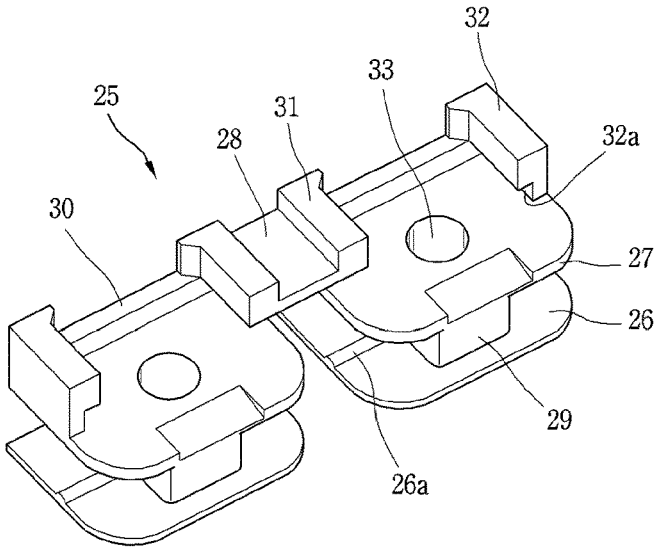

FIGS. 7 and 8 are front and rear perspective views of a molded-case circuit breaker for DC according to an embodiment of the present invention. FIG. 9 is a perspective view of the circuit breaker of FIG. 8, from which the terminal connecting units are removed. FIG. 10 is a perspective view of a terminal connecting unit.

A molded-case circuit breaker for DC according to an embodiment of the present invention includes a plurality of interruption units. The interruption units correspond to interruption units applied to respective phases (poles) of a molded-case circuit breaker for AC. That is, most of the components of the AC circuit breaker are employed. Therefore, for better comprehension, a molded-case circuit breaker with four interruption units will be described with respect to the R phase, S phase, T phase, and N phase. A DC four-unit circuit breaker 10 according to an embodiment of the present invention includes a case 11 and a cover 18 that constitute an outer casing, a switch mechanism (below a handle 51) that provides opening and closing forces, a base assembly 35 (see FIG. 13) provided for each interruption unit (each phase) and having a contact portion, a trip portion assembly 40 provided on the front of the base assembly 35, and a two-terminal connecting conductor 21.

The case 11 forms the bottom of the outer casing. The case 11 may have the approximate shape of a box with its top and part of its front and rear being open. The base assembly 35 is accommodated in the internal space of the case 11. Since the four-unit circuit breaker has four interruption units of the R phase, S phase, T phase, and N phase, it contains four base assemblies 35. The case 11 may be divided into four segments. FIG. 8 depicts an example in which the N phase, R phase, S phase, and T phase are arranged in this order from right. Terminal receiving portions 12 and 13 are provided on the front and rear of the case 11. The terminal receiving portions 12 and 13 are provided for each phase. Front terminal receiving portions 12 are provided on the front of the case 11, and rear terminal receiving portions 13 are provided on the rear of the case 11. The front terminal receiving portions 12 and the rear terminal receiving portions 13 provide a space where a load terminal or power source terminal can be mounted. Each terminal receiving portion may be connected to the power source or load.

The cover 18 is attached to the top of the case 11. The top side of the cover 18 is partially open, with a top cover 19 mounted on it. A handle 31 of the switch mechanism 30 is exposed through a hole at the center of the top cover 19, thereby allowing the user to manually apply an actuating force to it.

Figure 15:
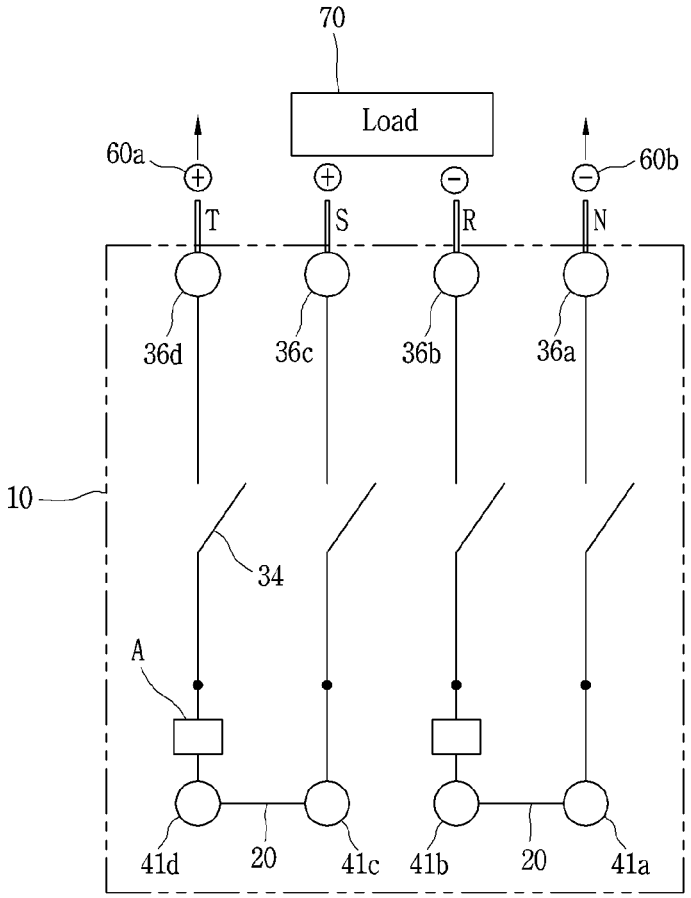
FIG. 15 is a wiring diagram of a molded case circuit breaker for DC according to an embodiment of the present invention.

In the rear terminal receiving portions 13, terminals of the respective phases are mounted. That is, a rear N phase terminal 36*a*, a rear R phase terminal 36*b*, a rear S phase terminal 36*c*, and a rear T phase terminal 36*d* are provided in terminal receiving portions of the respective phases, respectively. The terminal of each phase may be connected to the load or power source. FIG. 15 depicts an example in which the rear R phase terminal 36*b* and the rear S phase terminal 36*c* are connected to the load 70 and the rear N phase terminal 36*a* and the rear T phase terminal 36*d* are connected to the power source 60*a* and 60*b*.

In the front terminal receiving portions 12, terminals of the respective phases are mounted. That is, a front N phase terminal 41*a*, a front R phase terminal 41*b*, a front S phase terminal 41*c*, and a front T phase terminal 41*d* are provided in terminal receiving portions of the respective phases, respectively.

An insertion slot 15 is formed by partially cutting away a partition 14 between each front terminal receiving portion 12, that is, a wall (inter-phase wall) between each interruption unit. Preferably, the insertion slot 15 is formed at a position lower than the front terminals 41*a*, 41*b*, 41*c*, and 41*d*. A two-terminal connecting conductor 21 and a top plate 28 of the terminal connecting unit 20 may be inserted into the insertion slot 15.

A mounting portion 16 is provided at the bottom of each front terminal receiving portion 12. The mounting portion 16 may consist of a pair of guide bars that are provided for each phase to adjoin the bottom of a partition 14 or sidewall 17. The insertion slot 15 may be formed at the top of the mounting portion 16.

The terminal connecting unit 20 is provided to connect two front terminals (e.g., the front N phase terminal 41*a* and the front R phase terminal 41*b*). The terminal connecting unit 20 may include a two-terminal connecting conductor 21 and a mount 25.

The two-terminal connecting conductor 21 may be formed from a flat plate. The two-terminal connecting conductor 21 has such a length at which it can be connected to two adjacent terminals. The two-terminal connecting conductor 21 has a pair of coupling holes 22. Each coupling hole 22 corresponds in position to a terminal assembly hole 42 of each terminal. A recess portion 23*a* is formed in the middle on one side of the two-terminal connecting conductor 21, and cutaway portions 23*b* are formed on both sides thereof. The recess portion 23*a* facilitates insertion into the insertion slot 15, and the cutaway portions 24 allow for smooth insertion of the terminal connecting unit 20 when assembling it to the mounting portion 16, without hitting the partition 14 or sidewall 17. First fitting portions 24 are formed by partially cutting away both sides of the two-terminal connecting conductor 21.

The mount 25 is fitted to the mounting portion 16 of each front terminal receiving portion 12 to mount the two-terminal connecting conductor 21 on it. The mount 25 includes a bottom plate 26, an intermediate plate 27, and a top plate 28 that are placed at a certain distance apart from each other. The bottom plate 26 and the intermediate plate 27 each may come as a pair to be inserted into two adjacent front terminal receiving portions 12. For example, the bottom plate 26 and the intermediate plate 27 each may come as a pair to be inserted into the N phase and the R phase. Supporting posts 29 are provided between the bottom plate 26 and the intermediate plate 27. That is, the bottom plate 26, the supporting posts 29, and the intermediate plate 27 may form I-shapes when viewed from the front. Two corners of one side (the front from which the terminal connecting unit 20 is inserted) of the bottom plate 26 and intermediate plate 27 are smoothly rounded to allow for smooth insertion of the terminal connecting unit 20 when assembling it to the mounting portion 16, without hitting the partition 14 or sidewall 17.

A rib 26*a* is formed on a part of the bottom plate 26 to provide supporting force for fixing the bottom plate 26 when attached to the mounting portion 16. The two-terminal connecting conductor 21 is placed on the intermediate plate 27. The intermediate plate 27 supports the two-terminal connecting conductor 21. Through holes 33 are made through the intermediate plate 27, supporting posts 29, and bottom plate 26. Each through hole 33 corresponds in position to the terminal assembly hole 42 of each terminal and a coupling hole 22 of the two-terminal connecting conductor 21. Each through hole 33 provides a space (e.g., space for screwing) where a terminal of each phase and the two-terminal connecting conductor 21 are assembled.

The top plate 28 is placed between a pair of intermediate plates 27. The top plate 28 has a smaller area than the intermediate plate 27. The top plate 28 is connected to the intermediate plate 27 by means of a back plate 27. The back plate 30 connects the back sides of the intermediate plate 27 and top plate 28. The back plate 30 prevents the two-terminal connecting conductor 21 from coming off forward (to the front of the circuit breaker). The two-terminal connecting conductor 21 is fitted between the intermediate plate 27 and the top plate 28. A pair of partition supports 31 protrude from two top sides of the top plate 28. The partition supports 31 are fitted to the partition 14 to increase the attachment force of the mount 25 and the partition 14. When the terminal connecting unit 20 is inserted into a pair of front terminal receiving portions 12 and the top plate 28 is therefore fitted to the insertion slot 15, the partition supports 31 engage the partition 14, thus providing supporting force.

Wall supports 32 protrude from both ends of the intermediate plate 27 and back plate 30. The wall supports 32 may be symmetrical with respect to one of the partition supports 31. When the terminal connecting unit 20 is inserted into the front terminal receiving portions 12, the wall supports 32 engage the partition 14 or sidewall 17, thus providing supporting force. Under the wall supports 32, second fitting portions 32*a* are formed as recesses along the length. As the first fitting portions 24 of the two-terminal connecting conductor 21 are fitted into the second fitting portions 32*a* of the mount 25, attachment force is provided.

The two-terminal connecting conductor 21 is fitted between the top plate 28 and the intermediate plate 27. The top and bottom of the two-terminal connecting conductor 21 are supported by the top plate 28 and the intermediate plate 27, the sides thereof are supported by the wall supports 32, and the back thereof is supported by the back plate 30. The top of the two-terminal connecting conductor 21, except the parts blocked by the top plate 28 and the wall supports 32, may be exposed and come into contact with the terminals.

The terminal connecting unit 20 is inserted and attached to two adjacent front terminal receiving portions 12. The intermediate plate 27, supporting posts 29, and bottom plate 26 are fitted to the mounting portion 16, and the two-terminal connecting conductor 21 and the top plate 28 are fitted to the insertion slot 15. Accordingly, the two-terminal connecting conductor 21 connects two adjacent terminals together. For example the front N phase terminal 41*a* and the front R phase terminal 41*b* are connected.

Figure 13:
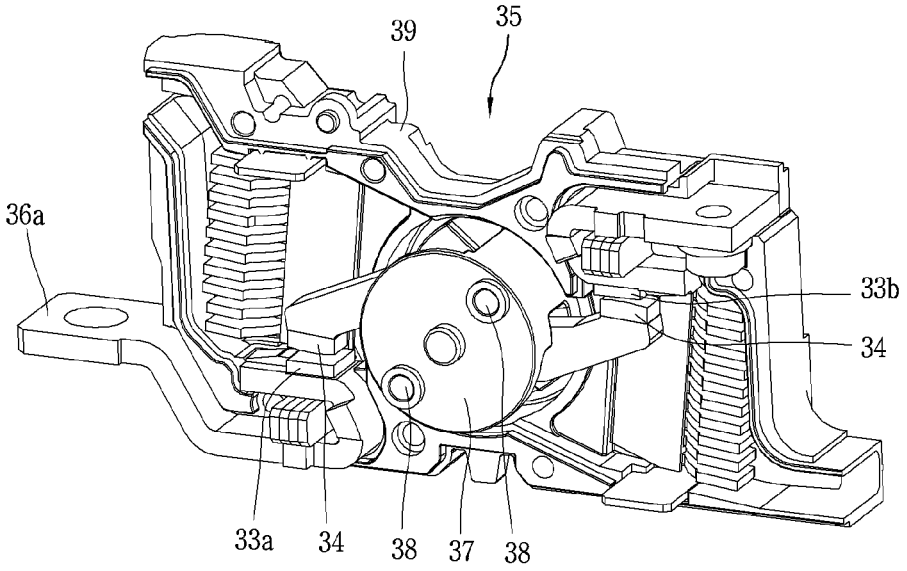
FIGS. 13 and 14 are perspective views of a base assembly and a trip portion assembly applied to a molded-case circuit breaker for DC according to an embodiment of the present invention.
Figure 14:
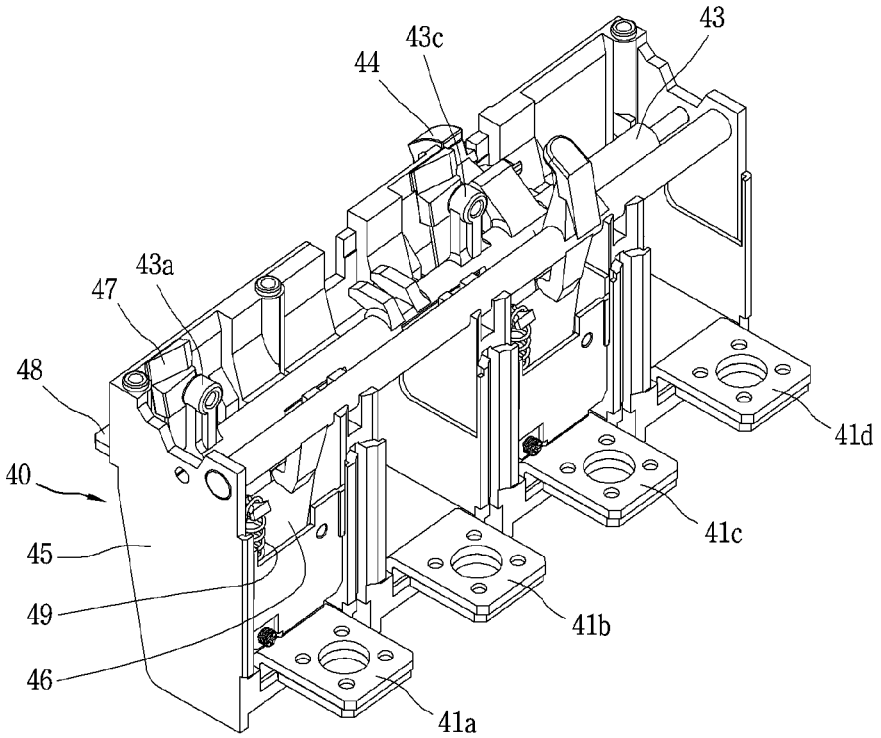

The base assembly 35 and the trip portion assembly 40 will be described with reference to FIGS. 13 and 14. The base assembly 35 is provided for each phase (each interruption unit). In the four-unit circuit breaker, four base assemblies 35 to be respectively applied to the N phase, R phase, S phase, and T phase are arranged in parallel. Each base assembly 35 has a contact portion within a base mold 39 formed from an injection-molded material. The contact portion includes fixed contacts 33*a* and 33*b* and movable contacts 34. As depicted in FIG. 13, in the case of twin contact type, the contact portion includes a pair of fixed contacts consisting of a rear fixed contact 33*a* and a front fixed contact 33*b* and a pair of symmetrical movable contacts 34. The rear fixed contact 33*a* is connected to the rear terminal 36*a*, 36*b*, 36*c*, or 36*d* of each phase. The rear fixed contact 33*a* and the rear terminal 36*a*, 36*b*, 36*c*, or 36*d* of each phase may be integrally formed. The rear terminal 36*a*, 36*b*, 36*c*, or 36*d* of each phase protrudes from one side (the rear side) of the base assembly 35, and the base assembly 35 is exposed through the rear terminal receiving portion 13 when attached to the case 11. Among the rear terminals 36*a*, 36*b*, 36*c*, and 36*d* of the respective phases, the rear N phase terminal 36*a* and the rear T phase terminal 36*d* may be connected to the power source 60*a* and 60*b*. Also, the rear R phase terminal 36*b* and the rear S phase terminal 36*c* may be connected to the load 70.

The pair of movable contacts 34 are mounted on a shaft 37 and rotate with the shaft 37. Each shaft 37 is connected by a shaft pin 38 and all the shafts 37 rotate together, thereby causing the contact portions of the four units to open and close simultaneously. The switch mechanism is mounted on the base assembly 35 of a certain phase, typically, the S phase base assembly, and transfers actuating force to the shaft pin 38 that is attached to a part of the switch mechanism. The operations of the movable contacts and switch mechanism are identical to those in the conventional art, so any further detailed descriptions of them will be omitted.

The trip portion assembly 40 is mounted on the front of the base assembly 35. The trip portion assembly 40 detects an over-current flow in a circuit and interrupts it, and may include a trip portion case 45, a crossbar 43 mounted across the trip portion case 45, a heater 48 connected to the front fixed contact 33*b* of the contact portion, bimetal 47 that is bent by heat generated from the heater 48 in case of an over-current in a circuit and that presses a contact region 43*a* or 43*c* of the crossbar 43 to rotate the crossbar 43, a chute 44 that rotates when released from the crossbar 43 to strike a nail (not shown) of the switch mechanism and allow the switch mechanism to perform an off operation, a magnet (not shown) that has a magnetic force, an armateur 46 that is magnetized in case of a sudden over-current ad rotates in the direction of the magnet to rotate the crossbar 43, and a trip spring 49. The front terminal 41*a*, 41*b*, 41*c*, or 41*d* of each phase may be connected to the heater 48 or formed integrally with the heater 48 and exposed to the front of the trip portion case 45. Some A of the components of a tripping mechanism including the bimetal 47, magnet, amarteur 46, and trip spring 49 may be provided at one of two adjacent phases. For example, some A of the components of the tripping mechanism may be provided at one of the N and R phases and one of the S and T phases. That is, some A of the components of the tripping mechanism may not be provided at the other of the S and T phases and the other of the N and R phases. That is, the tripping mechanism is common to two adjacent phases (units). For example, a tripping mechanism may be common to a pair of units connecting the N phase and the R phase, and another tripping mechanism may be common to a pair of units connecting the S phase and the T phase.

The crossbar 43 has a plurality of contact regions 43*a* and 43*c* that protrude to make contact with the bimetal 47. The contact regions may be formed at two phases. For example, the first contact region 43*a* is provided at one of the N and R phases, and the second contact region 43*c* is provided at one of the S and T phases. That is, no contact region may be provided at the other of the N and R phases and the other of the S and T phases.

A wiring diagram of a four-unit molded-case circuit breaker for DC according to an embodiment of the present invention will be described with reference to FIG. 15.

The power source 60*a* and 60*b* and the load 70 are connected to the terminals of respective phases provided on the rear of the DC circuit breaker 10. For example, the plus pole 60*a* of the power source 60*a* and 60*b* is connected to the rear T phase terminal 36*a*, and the minus pole of the power source 60*a* and 60*b* is connected to the rear N phase terminal 36*b*. Also, the plus pole of the load 70 is connected to the rear S phase terminal 36*c*, and the minus pole of the load 70 is connected to the rear R phase terminal 36*b*.

To connect two adjacent front terminals, a terminal connecting unit 20 is attached to them. Since the two adjacent front terminals are connected directly by the terminal connecting unit 20, no externally connected conductors are required. Also, the terminal connecting unit 20 is contained within a terminal receiving portion in the outer casing of the DC circuit breaker 10, it is closed off from the outside, thus improving insulation performance.

According to a molded-case circuit breaker for DC according to an embodiment of the present invention, a two-terminal connecting conductor is provided to connect two adjacent terminals and therefore no externally connected conductors are required. Accordingly, the user does not need to add more connecting conductors, and the assemblability of the power source and load is improved.

Moreover, since the two-terminal connecting conductor is configured as an assembly unit (terminal connecting unit) to be fitted to a mount, it can be easily assembled to a mounting portion on the case by fitting, which results in higher assemblability.

In addition, since a connecting conductor is configured within the outer casing, external insulation breakdown is prevented and occupied space is reduced.

Further, the number of tripping mechanism components can be reduced, thus leading to a reduction in parts and production cost.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A molded-case circuit breaker for DC that contains a plurality of interruption units, the DC circuit breaker comprising a terminal connecting unit that connects terminals of adjacent interruption units, the terminal connecting unit being placed within a terminal receiving portion on a front or a rear of an outer casing of the circuit breaker, wherein a mounting portion is provided in the terminal receiving portion and consists of a pair of guide bars that adjoin a bottom of a partition or sidewall, wherein the terminal connecting unit comprises:

a two-terminal connecting conductor formed from a flat plate; and a mount that is fitted to the mounting portion, with the two-terminal connecting conductor mounted on a top, wherein the mount comprises:

a bottom plate, an intermediate plate, and a top plate that are placed at a certain distance apart from each other, supporting posts connecting the bottom plate and the intermediate plate, and a back plate connecting back sides of the intermediate plate and top plate, wherein the bottom plate and the intermediate plate each come as a pair to be inserted into the terminal receiving portions of two adjacent interruption units, and wherein the top plate is placed between a pair of intermediate plates.

2. The circuit breaker of claim 1, wherein an insertion slot for inserting the terminal connecting unit is formed by partially cutting away the partition.

3. The circuit breaker of claim 2, wherein the insertion slot is formed at a top of the mounting portion.

4. The circuit breaker of claim 1, wherein the two-terminal connecting conductor has a pair of coupling holes corresponding in position to terminal assembly holes of the terminals.

5. The circuit breaker of claim 1, wherein a recess portion is formed in a middle on one side of the two-terminal connecting conductor, and cutaway portions are formed on both ends thereof.

6. The circuit breaker of claim 1, wherein through holes are made through the intermediate plate, supporting posts, and bottom plate and connected to the coupling holes.

7. The circuit breaker of claim 1, wherein the two-terminal connecting conductor and the top plate are inserted into the insertion slot, and the mounting portion is fitted between the intermediate plate and the bottom plate.

8. The circuit breaker of claim 1, wherein a pair of partition supports protrude from two top sides of the top plate.

9. The circuit breaker of claim 1, wherein wall supports protrude from both ends of the intermediate plate and back plate.

10. The circuit breaker of claim 1, wherein the two-terminal connecting conductor is inserted between the top plate and the intermediate plate.

* * * * *